US006179291B1

(12) United States Patent
Vancura

(10) Patent No.: US 6,179,291 B1
(45) Date of Patent: Jan. 30, 2001

(54) CASINO GAME METHOD OF PLAY

(76) Inventor: Olaf Vancura, 1801 N. Green Valley Pkwy. #421, Henderson, NV (US) 89014

( * ) Notice: Under 35 U.S.C. 154(b), the term of this patent shall be extended for 0 days.

(21) Appl. No.: 09/050,763

(22) Filed: Mar. 30, 1998

Related U.S. Application Data

(60) Provisional application No. 60/042,572, filed on Apr. 2, 1997.

(51) Int. Cl.[7] ..... A63F 1/00
(52) U.S. Cl. ..... 273/292; 463/12; 463/13
(58) Field of Search ..... 273/292, 306, 273/274; 463/12, 13

(56) References Cited

U.S. PATENT DOCUMENTS

| | | | | |
|---|---|---|---|---|
| 4,711,453 | | 12/1987 | Saint Ive | 273/268 |
| 5,324,041 | | 6/1994 | Boylan et al. | 273/292 |
| 5,431,407 | * | 7/1995 | Hofberg et al. | 273/292 |
| 5,538,252 | * | 7/1996 | Green | 273/306 |
| 5,673,917 | | 10/1997 | Vancura | 273/292 |

FOREIGN PATENT DOCUMENTS

| | | | | |
|---|---|---|---|---|
| 2216322 | * | 10/1989 | (GB) | 273/138 A |
| 2262642 | * | 6/1993 | (GB) | 273/143 R |

OTHER PUBLICATIONS

"Banker and Broker", Scarne's Encyclopedia Of Games, John Scarne, Harper & Row Publishers, pp. 315–316, 1973.*

"Over/Under 13 Blackjack", Gaming Concepts, Inc., 1988.*

Vancura, Olaf "Smart Casino Gambling" pp. 155–174 Baccarat, pp. 175–238 Blackjack, pp. 131–154, 283–284 Craps.

* cited by examiner

*Primary Examiner*—Benjamin H. Layno

(57) ABSTRACT

The invention comprises a wagering game that utilizes random events and their associated values. The teachings include a set of higher/lower hitting and standing rules in which a participant's successive event values are compared to determine the success or failure of a strategic decision. As a table game vs. a house dealer, the overall player's objective in a preferred embodiment is not to bust while achieving more hits than the dealer who plays by a fixed set of rules. Variations include a solitaire version, different payoff criteria and schedules, different definitions of what constitutes a successful hit, versions with a guaranteed-winner bonus round, and the introduction of jokers which may be helpful and/or harmful to the player's hand.

21 Claims, 2 Drawing Sheets

CASINO GAME METHOD OF PLAY

RELATED APPLICATION

This application claims priority to the provisional application entitled "CASINO GAME METHOD OF PLAY" filed on Apr. 2, 1997 (Application No. 60/042,572).

FIELD OF THE INVENTION

This invention relates to betting games suitable for casino play.

BACKGROUND OF THE INVENTION

Objectively, all successful casino games have a positive expectation for the house against the average player. This is simply a necessity to ensure casino profitability.

More subjectively, successful casino games are also easy to understand, easy to deal, and fun to play. Complex rules make for difficulty in learning by patrons. A general rule of thumb is that the game should be comprehensible to customers within a few minutes of introduction. Moreover, the game also must be easy for casino personnel to understand. Dealers must learn to broker the game, and pit supervisors must be able to quickly identify miscues and resolve any disputes on the part of players or dealers.

Variety is a further beneficial required element of play, be it in the betting, the play itself, or a combination of these. It has been said that no two games of chess are ever alike. So too, with casino games, the customer is demanding more entertainment for their gambling dollars.

Certainly one of the easiest concepts to comprehend is that of comparing two quantities and determining which is greater. An extension of this is the comparison of two numbers to determine which is higher and which is lower.

This idea is so universal that it would be desirable to create a casino game employing such a simple higher/lower method of building a hand. In principle, players could decide on whether the value of a future even would be higher/lower than a previous value In particular, successive events could be employed with regard to decision-making, and the total number of such events in the hand used as the score. The advantage of this type of game is that newcomers could quickly grasp the rules. A further advantage is that while some decisions are more risky than others, the general chance of a success, per decision, does not decay as the hand is built.

The game could be played with cards, for example, with a dealt card serving as a random event and its rank comprising the associated value. Such was the case with the former television game show *Card Sharks,* in which contestants, in part, conjectured upon the relative rank of cards as compared to those previous.

Several casino games presently employ the concept of comparing two quantities during the course of game play. For example, we can consider card games. In Blackjack, the values of unbusted hands are compared to determine the winner, with the higher total prevailing. In Baccarat also, totals are compared to resolve wagers. A more recent casino entry, Casino War (Boylan et al., 1994, U.S. Pat. No. 5,324,041), utilizes a single card dealt to the player and dealer, with the higher card winning. Another example is a dice game like Craps, where players are allowed to wager on, among other things, a total of exactly 7, over 7, or under 7, for the next roll of two dice.

Pyramid Dice (Saint Ive, 1987, U.S. Pat. No. 4,711,453) functions in a somewhat different manner. The game also uses two dice to produce random events. However, the player generally rolls until re-rolling a combination which has previously appeared, and the number of rolls at that point are compared to a pay table. However, since re-rolling any previous combination stops the game, the player's chance of success decays considerably as the number of rolls, hence number of previous combinations, increases.

Destiny 21 (Vancura, 1997, U.S. Pat. No. 5,673,917), a side bet for Blackjack, utilizes the number of cards in hand to compare to a pay table. However, the criterion for determining successful hits is simply that of Blackjack, i.e. a total less than or equal to 21. Thus, as with Pyramid Dice, the player's chance of success decays considerably as the number of hits grows.

With slot machines, the player participates in a solitary way. This has proved popular as many individuals prefer the fact that "no one is critiquing" their strategy, and that they may play as fast or as slow as desired.

On the other hand, in Blackjack the player vs. dealer motif is quite popular with casino patrons. It would thus be desirable to create an embodiment with a similar friendly rivalry. Additionally, the popularity of Blackjack can be traced to the notion that people are in charge of their own hands and can play them as they see fit. So, too, a new game would be well served in allowing players complete control over the play of their hands. In Blackjack, the house edge arises because in hands in which both the player and dealer bust, the house wins. This is a subtle effect because it rarely occurs; it would be advantageous to incorporate a similar conceptual house edge in a new game.

In summary, there is the need for a very simple casino game with high replay value and significant strategy decisions that the player controls. Ideally, the game could utilize a simple higher/lower type of theme in comparing successive random events, use the total number of such events in a hand as the score, and embody both solitaire and player vs. dealer motifs.

SUMMARY OF THE INVENTION

The present invention is a method for playing a game. The game employs random events, each of which has at least one assigned value, in conjunction with a method of hitting (sometimes referred to as drawing) and standing in which each player must continually surmise, for his/her hand, how next event's value will compare to the immediately previous event's value.

In principle, any device capable of generating random data, which are subsequently ordered according to some predefined algorithm, can be employed to generate a series of events, hence associated values, used as input for the game. Both independent and dependent events can be utilized.

As an example of independent events, the rolling of two dice may be used as the random events, and their sum adopted as the value. Alternatively, a random number generator (many of which are commercially available) may be used to provide independent random events, and the number itself (or, e.g., a multiple thereof truncated to an integer) adopted as the value.

Dependent random events may arise, for example, through the use of one or more shuffled decks of playing cards in which successive hands are played from the same pack. For example, individually dealt cards may be utilized to provide random events, with card rank adopted as the associated value. Alternatively, pairs of cards may be dealt with their numerical sum adopted as the associated value, and so forth. As another example, cards may be employed but suits utilized as the adopted values. Or, cards may be employed with rank as the primary value and suit as a secondary, tie-breaking value.

Another example of random events are the use of numbered balls, for example as commonly used in existing Keno or lottery games. In this case, the drawing of balls may comprise the random events, and their numerical labels may provide the associated value. The game may be played with replacement (drawn balls are immediately replaced before mixing and redrawing), hence allowing for independent events, or without replacement (drawn balls stay out until the next game), hence allowing for dependent events. Too, the drawing of balls may occur from successive independent sets of balls. Alternately, as in the case of Keno, the selection of 20 balls may serve as the random event, and their numerical sum as the associated value. A Roulette or other wheel outcome may also serve as the random event, e.g. for Roulette with ordered values 00, 0, 1, 2, 3, . . . , 36 from lowest to highest.

In general, a variety of hitting mechanisms may be employed to establish a score. A preferred method has participants indicate "higher" or "lower" in a designation of whether the next event's value will be greater than or less than the immediately previous event's value. The events may be common to all participants (e.g., as in Craps), or each participant may be given a distinct set of events (e.g., as in Blackjack).

The designation of "higher" or "lower" may be strictly enforced (i.e., tie values are not successful hits) or loosely enforced (i.e., tie values are successful hits). Alternately, participants may simply indicate "hit" whereby it is assumed that the player is hitting in the direction with the greater chance of success. In another embodiment, a successful hit is defined as any dealt event with value not equal to that immediately prior. In a preferred embodiment, the score is equal either to the number of events in the hand or to the number of hits.

The game may be played in a solitaire embodiment, in which only a player's hand and associated score is adopted. In this case, for example, the player's hand score may be compared to a pay table to determine game resolution. Alternately, both a player and a dealer may build hands, whose scores are later compared in order to determine the resolution. Note that in this case, the dealer's hand need not represent an agent of the house, but may instead be another player designated as "dealer" or "banker."

The invention is capable of being played as a standard game, e.g. on a casino floor, or as a video slot machine. In a table game version, the game is played on a surface delineated with a plurality of areas for patrons to make wagers. In principle, wagers may be made with money, gaming chips, credits, or their mechanical equivalent. A dealer brokers the game and deals the cards.

In a video version the screen has regions for the player and (as appropriate) dealer cards. A video representation the random events is adopted, and money, gaming chips, credits, or their video equivalent may be wagered. Buttons, either on screen (e.g., a touch-screen) or adjacent to the monitor, are provided for players to input their intentions. An executable computer software program, or a hardware equivalent such as an EPROM, brokers and deals the game according to the rules of play.

In a preferred method of play, suitable for a live table game or video incarnation, the invention utilizes an 8-deck pack of cards, with individually dealt cards as events, and rank as their value. An Ace is the highest value and a Two (Deuce) is the lowest. Players initially make wagers and are pitted against a dealer's hand.

The player and dealer each receive one face-up card to begin play. Alternatively, the participants may be given the option to select from more than one event to begin play. A player counter and a dealer counter are each initialized to 1. Thereafter, each player has the option to hit higher than his previous (initially dealt) card, hit lower than his previous card, or stand. If the decision was to hit and was unsuccessful, the player is said to have busted, therefore his score PS is null, and the wager is lost. It is to be expressly stated that we are using the terms "null" and "null value" to indicate a hand with an unsuccessful hit or draw.

If the decision was to hit and was successful, the player's counter is incremented by 1 and the player again has the option to hit higher, hit lower, or stand, with the card just dealt now assuming the role of immediately previous card. If the decision was to stand, the value of the player counter is adopted as the player's score PS. Note that the player's score PS may equal 1 if the player stood without taking any hits.

Once all players have finished, hence either stood or busted on their own hands, the dealer finishes the house hand. The dealer plays by a fixed set of rules. As with the player, the dealer counter is incremented by 1 for each successful hit, and adopted as the dealer's score DS if the dealer ultimately stands. If the dealer instead busts, the dealer's score DS is the null value.

After the dealer has finished, the player's score is compared to the dealer's score to determine successful and unsuccessful bets, and make payoffs as appropriate. If desired, the composition of hands (i.e., their individual events and values) may also be used to determine hand outcome.

In an alternate embodiment, mathematically equivalent to that described above, each counter begins at 0 and increments exactly as above. Therefore PS and DS are determined to be the total number of successful hits, as opposed to the total number of cards in hand. The teachings of this invention allow for any initialization of the counter value.

In a preferred embodiment, a successful hit is one which the player and/or dealer is strictly correct in hitting higher or lower, i.e. if the next card is equal in value to the previous, then the hit is unsuccessful and busts. In another embodiment, a hit is not penalized for receiving a card equal in value to the previous card. This may be counted as a successful hit and the hand allowed to continue. Or this event may force the player and/or dealer to stand while it may or may not increment the number of successful hits.

In another embodiment, the player and/or dealer merely indicates hit, and it is assumed that the indication is to hit in the direction which affords the greater chance of success. For example, if the previous card was a Three, a hit would imply hit higher, since that is the best play. Mathematically, in this example we may assign a critical value CV to be the median value of Eight (6 cards higher, 6 cards lower), and assume that any hit indicates a direction toward CV.

In another embodiment, the player and/or dealer merely indicates hit, and for the subsequently dealt random event, any associated value not equal to that immediately prior is considered a successful hit.

Many embellishments to the teachings of this invention are possible. For example, in one embodiment, a subset of the card values (e.g., Aces and Deuces) are afforded the privilege of not being penalized should they be equal in value to the previous card. In another embodiment, some events have values which can simultaneously be both highest and lowest, much like the Ace's role in traditional poker, so that a player drawing to this event has a "free hit."

In another embodiment, a secondary associated value is used, if necessary, to determine whether a hit is successful or unsuccessful. For example, should a player hit and receive a card equal in rank to that prior, the suit values associated with the prior card and hit card may be utilized in determining the success or failure of the hit.

In another embodiment, the player may guarantee a victory by successfully hitting a prescribed number of times and entering a bonus round, regardless of the ultimate dealer's score. Once in the bonus round, the player may accumulate further winnings through additional successful hitting.

In another embodiment, players may make an additional wager, pay a fee, or surrender a portion of their original wager, to substitute a newly dealt event for an undesirable event.

In another embodiment, players may wager, either prior to the hand or prior to a hit, that the next card will be equal in value to that immediately prior. This extra wager thus represents a form of "insurance" for the players.

In another embodiment, a player who busts may pay an additional amount to become unbusted and continue the hand.

In another embodiment reminiscent of Blackjack, players may make an additional wager or pay a fee to "split" a hand with successive events of the same value. In this case, the newly dealt event may be moved to begin a new hand, and two hands are then played out. Also reminiscent of Blackjack, players may be given the option to "double down" by making an additional wager, e.g. up to the original amount, and drawing only one more card. In this case, players would have more money in play.

In another embodiment, jokers are added to the deck. These jokers can be used by the party receiving them (the player or house) as any card desired. In still another embodiment, jokers cause the hand containing them to automatically bust.

In another embodiment, portions of the original wagers are contributed to a progressive jackpot fund. The jackpot fund accumulates until a player reaches prescribed hands (for example, a hand of 20 successful hits, a hand with 5 hits and last roll a 12, etc.) after which all or a fraction is awarded to the player. Alternatively, players may strive to complete a "scorecard" of several hands of predetermined types, throughout the play of several games. When a predetermined level of accumulation is achieved, the player receives a prize. Too, a separate or side wager may be employed in which players may wager on predetermined outcomes, such as a hand of 10 successful hits, etc. It is to be expressly understood that hand outcomes, either through the course of play or through a jackpot component, may include not only the score but also the composition of the individual events.

In another embodiment, several tables and/or video machines may be linked together to allow a tournament-type of arrangement. Players may vie against each other to see who is the first to achieve a certain level of winnings, type of hand, or complete a scorecard.

In another preferred embodiment, compatible with the embodiments and variations to the player's hand as described above, a dealer's hand is not employed, and the player's score is compared to a reward table to determine payoffs. In this case, if the player has achieved a prescribed number of hits suitable of a payoff by standing, he may be given the option of keeping a portion of these winnings and continuing a modified-payoff game with the remainder of said winnings. Also, the player may be given the opportunity to enter a bonus round and guarantee a win. Similar in nature to that described above, the bonus round may give incremental rewards for each additional successful hit, or any incremental reward may be an "all or nothing" arrangement.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
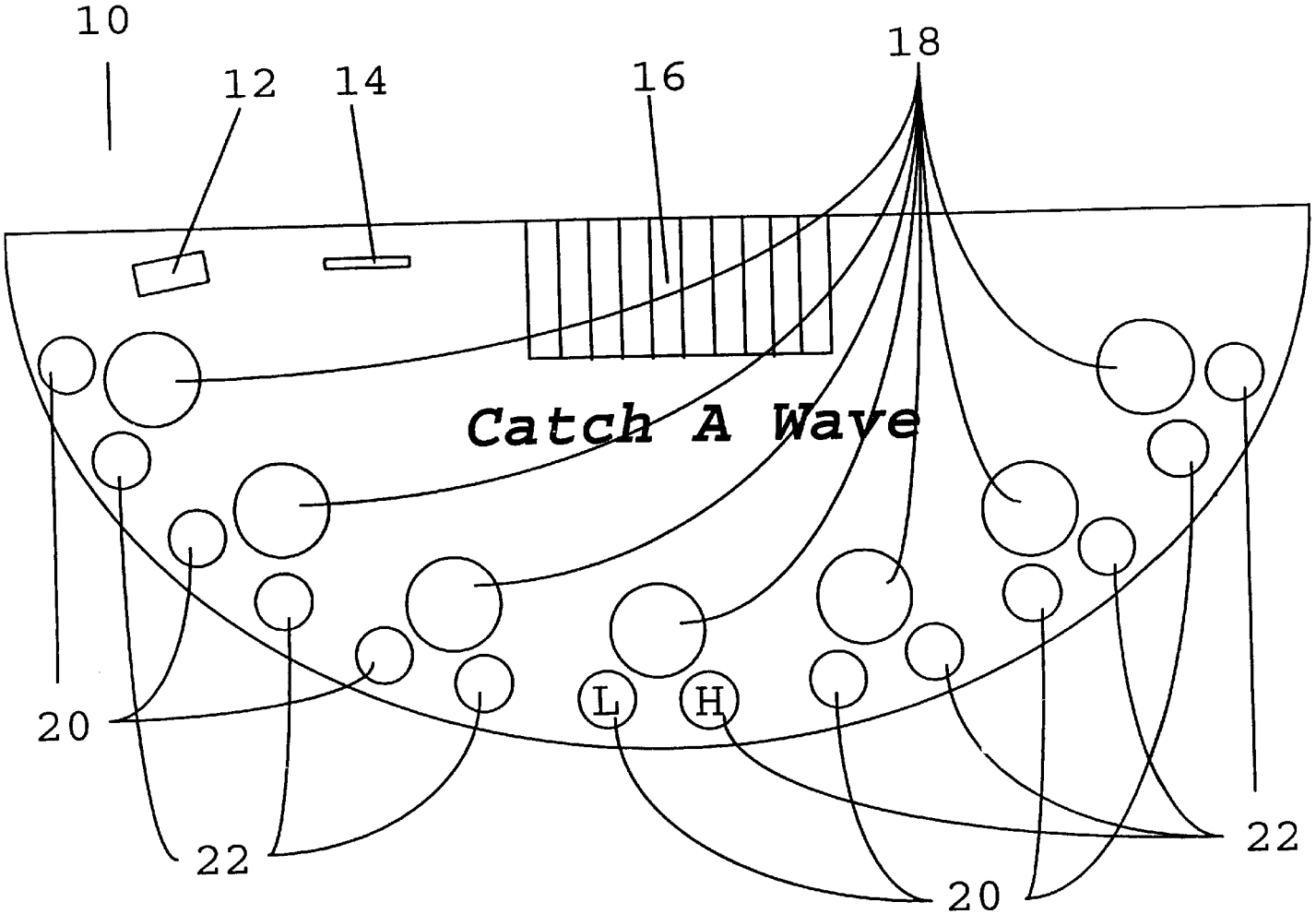
FIG. 1 is a top view illustration of a preferred table game layout for a preferred embodiment of the invention.

FIG. 1 shows a playing surface 10 for a betting game described herein. A designated dealer, representing the casino, may broker the game and deal the pack of cards. Typical tables are equipped with a card discard holder 12, a money drop slot 14, and a dealer's chip tray 16. The main wagering areas 18 are each depicted. Areas in which players may tap the felt indicating their desire to hit higher 22 or hit lower 20 are also depicted.

Before a hand begins, players, by placing bets of money, gaming chips, credits, or their video or mechanical equivalent in the appropriate areas, may wager on the main wagering areas.

In a preferred embodiment, a shuffled pack of 8 ordinary decks of cards is used. The dealer deals one card, face-up, to every player and himself. Aces are considered the highest cards (rank 14), and Twos (Deuces) are the lowest (rank 2). Players in turn then play out their hands in the following manner, with each player taking their turn, and finishing their hand, before proceeding to the next player. A player's decisions are made relative to his own distinct cards.

Upon and during his turn, a player always has one of three choices to make: to stand, to hit higher than his previous card, or to hit lower than his previous card. If the player decides to stand, his turn is over and his score PS is determined to be the number of prior hits. If the player decides to hit, a new card is drawn and placed on the layout partially overlapping the player's previous card. Should the player have been correct in his hit (that is, he guessed hit higher and the new card was, indeed, higher in value than that immediately previous; or he guessed hit lower and the new card was lower in value than that immediately previous), PS is incremented by 1. The player then again has the same three choices to make, with the most recent drawn card now assuming the role of previous card. Should the player have been incorrect, he is said to have "busted," with a resultant null score, and his wager is immediately lost.

When all players have finished, either by standing or busting, it is the dealer's turn. The dealer abides by the same rules for hitting and standing as the players. However the dealer's strategy is objectively fixed to be the following:

On the first decision:

Hit higher if the initial card is an Eight or less.

Hit lower if the initial card is a Nine or more.

On all subsequent decisions:

Hit higher if the previous card was a Four or less.

Stand if the previous card was in the range Five to Jack inclusive.

Hit lower if the previous card was a Queen or more.

On the first card, the dealer must always hit higher if the initial card's value is 8 or less, and hit lower if the initial card's value is 7 or more. On subsequent cards, the dealer must hit higher if the previous card's value is 4 or less, hit lower if the previous card's value is Queen or more, and stand if the previous card's value is greater than or equal to 5 and less than or equal to Jack. To portray this algorithmically, we may assign values DL=9, DH=8 to the dealer's first decision, and DL=5, DH=11 to all subsequent dealer decisions. The dealer will then hit lower if the previous card is greater than DH, hit higher if the previous card is less than DL, and stand if the previous card is greater than or equal to DL and less than or equal to DH.

By analogy with the player, the dealer's score DS is equal to the number of hits taken, with a dealer bust resulting in null dealer score.

When all hands are finished, the players with non-null scores (i e., PS≧0) are compared to the dealer's score to determine payoffs. Should the dealer have a null score, all players with non-null scores are paid at 1 to 1 odds. Otherwise, if the player's non-null score PS is greater than the dealer's non-null score DS, the player is paid at odds equal to their difference PS−DS. For example, if a player received 5 successful hits (a player's score of 5), and the dealer received only 1 successful hit (a dealer's score of 1), the player would be paid 4 to 1 on the original wager. If the dealer's score is greater than the player's score, the player's wager is lost, while tie scores result in a push with no money changing hands. With optimal play, the player's expectation is roughly−1.1%

In variation to the above, the payoff rules are changed slightly. First, a bonus round is created; a player enters the bonus round by successfully making a predetermined number of hits. Once in the bonus round, the player is assured of winning and the dealer's hand becomes irrelevant. The player can win even more with additional successful hits. Second, if a player stands before entering the bonus round, and the player's score is greater than the dealer's score, the player is paid at only 1 to 1 odds. Table 1 shows three sample payoff schedules utilizing this concept. With optimal play, the player's expectation is roughly −2.0%, −0.1%, and −0.6%,

TABLE 1

| Number of Successful Bonus Hits | Payoff |
|---|---|
| Schedule A: Enter Bonus Round After 5 Successful Hits | |
| 0 | 1 to 1 |
| 1 | 2 to 1 |
| 2 | 4 to 1 |
| 3 | 7 to 1 |
| 4+ | 10 to 1 |
| Schedule B: Enter Bonus Round After 6 Successful Hits | |
| 0 | 1 to 1 |
| 1 | 2 to 1 |
| 2 | 3 to 1 |
| 3 | 5 to 1 |
| 4 | 9 to 1 |
| 5 | 15 to 1 |

TABLE 1-continued

| Number of Successful Bonus Hits | Payoff |
|---|---|
| 6 | 25 to 1 |
| 7+ | 50 to 1 |
| Schedule C: Enter Bonus Round After 7 Successful Hits | |
| 0 | 1 to 1 |
| 1 | 2 to 1 |
| 2 | 3 to 1 |
| 3 | 4 to 1 |
| 4 | 5 to 1 |
| 5 | 10 to 1 |
| 6 | 50 to 1 |
| 7+ | 100 to 1 |

In another preferred embodiment, the rules and payoffs are modified slightly. The dealer's rules are fixed to be the following:

On the first decision:

Hit higher if the initial card is a Seven or less.

Hit lower if the initial card is an Eight or more.

On all subsequent decisions:

Hit higher if the previous card was a Four or less.

Stand if the previous card was in the range Five to Ten inclusive.

Hit lower if the previous card was a Jack or more.

As before, the player may stand or hit at will. If the player busts, his/her wager is lost. Otherwise, if the dealer busts, the player is paid 1 to 1. Should the player and dealer each establish non-null scores (i.e., neither busts as PS≦0 and DS≦0), the following occurs: if the player beat the dealer (i.e., PS>DS), then the player is paid at odds equal to their difference PS−DS; if PS=DS, the hand is a push; and if PS<DS, the player loses. The bonus round is modified such that the player, upon taking six successful hits, is immediately paid 6 to 1. With optimal play, the player's expectation is−0.3%.

Figure 2:
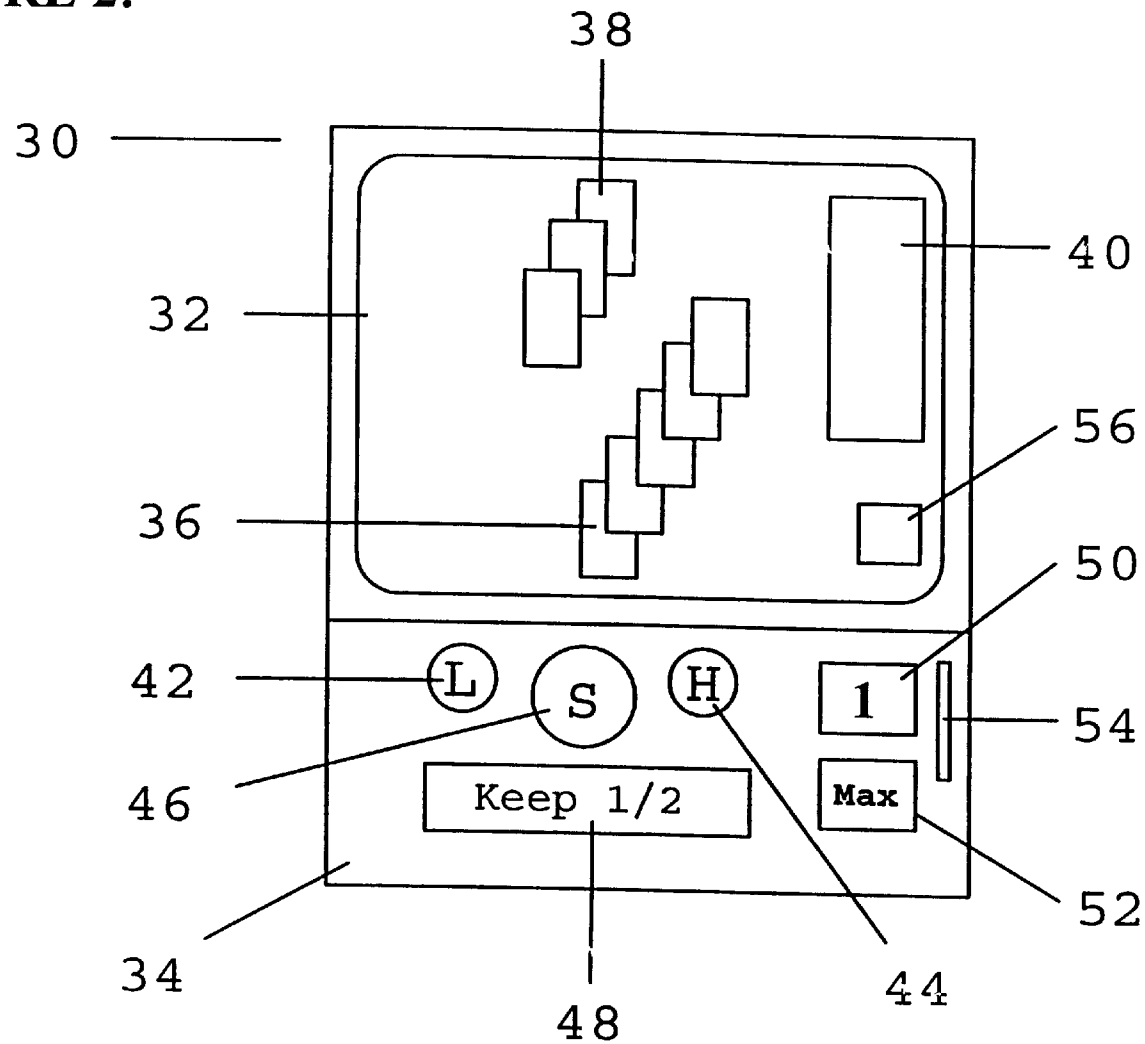
FIG. 2 is a front view illustration of a video version for an alternate embodiment of the invention.

In an alternate preferred embodiment suitable for video slot machine play, the dealer's hand is eliminated altogether. FIG. 2 shows a playing area 30 for a video version of the solitaire betting game described herein. The video slot machine typically includes a video screen 32 as well as a console 34. Areas for coin insertion 54 and buttons for wagering either one unit 50 or the maximum units 52 are included. On screen, areas for the player's cards 36 and, if applicable, dealer's cards 38 are included, together with areas indicating reward tables 40 and credits 56. Buttons indicating hit higher 44, hit lower 42, and stand 46 are available for the player to push in making strategic decisions.

Here, the player tries to achieve the maximum number of hits possible. Should the player bust, any potential winnings are lost, so it is paramount to stand at some point. Table 2 shows a sample payoff table for a 2-deck version of this game. In addition, a "Keep ½" button 48 is offered should the player choose this option. Note that the "Keep ½" option allows players upon reaching a prescribed number of hits, e.g., 8 or at any later time prior to busting, to receive half of the potential standing payoff which is immediately credited to them. Subsequently, the remaining reward levels are halved, and the player continues the game just as before, perhaps again utilizing the "Keep ½" option later in the game. With optimal play, the player's expectation for this embodiment is approximately−4.2%

TABLE 2

| Number of Successful Hits Before Standing | Payoff |
|---|---|
| 0 | Lose |
| 1 | 1 for 1 |
| 2 | 1 for 1 |
| 3 | 2 for 1 |
| 4 | 3 for 1 |
| 5 | 4 for 1 |
| 6 | 6 for 1 |
| 7 | 9 for 1 |
| 8 | 12 for 1 |
| 9 | 16 for 1 |
| 10 | 24 for 1 |
| 11 | 32 for 1 |
| 12 | 40 for 1 |
| 13 | 60 for 1 |
| 14 | 120 for 1 |
| 15 | 200 for 1 |
| 16 | 300 for 1 |
| 17 | 400 for 1 |
| 18 | 600 for 1 |
| 19+ | 1000 for 1 |

The payoffs for an alternative version ilizing only a player's hand are depicted in Table 3, also amenable to a video embodiment. In this case, the player also loses the wager if busting, unless he makes a predetermined sufficient number of hits to enter the bonus round. As before, once in the bonus round, the player cannot lose. In this case, the player is guaranteed a 25 for 1 payoff once in the bonus phase. Thereafter, each successful hit contributes additional winnings, up until the player ultimately busts, at which point the hand is finally over and the player is rewarded based on the number of total (including bonus) successful hits to that point. With optimal play, the player's expectation for this 2-deck version is roughly−0.4%.

TABLE 3

| Number of Successful Hits Before Standing | Payoff |
|---|---|
| 0 | Lose |
| 1 | 1 for 1 |
| 2 | 1 for 1 |
| 3 | 2 for 1 |
| 4 | 3 for 1 |
| 5 | 5 for 1 |
| 6 | 7 for 1 |
| 7 | 9 for 1 |
| 8 | 12 for 1 |
| 9 | 15 for 1 |
| 10 | 20 for 1 |
| | Enter Bonus Round |
| 11 | 25 for 1 |
| 12 | 30 for 1 |
| 13 | 40 for 1 |
| 14 | 50 for 1 |
| 15+ | 100 for 1 |

In other embodiments, multiple bonus milestones may be employed.

In another alternative version, suitable for use as a bonusing feature, for example on an underlying slot machine, the dealer's hand is again not employed. As a bonus, the player need not wager and tries to achieve the maximum number of hits possible without busting. A player who stands is rewarded based on a comparison with a pay table. Should the player bust, he may still be rewarded e.g. based on a comparison of a pay table with either the prior number of successful hits or the total number events, as desired. Under the teachings herein, this invention may be employed as a genric coin-dispensing means, in any situation in which an average payout is desired. For example, a unique combination of symbols on a slot machine or a random drawing may be utilized to invoke the present invention as a bonusing or coin-dispensing mechanism.

While the invention has been described with reference to specific embodiments, other variations or modifications will be apparent to those skilled in the art. Therefore, the invention should not be limited by the foregoing description. Rather, the scope is to be interpreted in conjuntion with the appended claims.

What is claimed:

1. A method of playing a game comprising the steps of:

(a) a player making a wager;

(b) dealing a random event to a player and a dealer, said random event having an associated value;

(c) said player standing or hitting;

(d) if the player stands, establishing player's score based on the number of events dealt to said player;

(e) if the player hits, dealing a new random event to said player, said hit being deemed successful or unsuccessful based on a comparison of the associated value of said new random event to the associated value of said player's immediately preceding event;

(e1) should said hit be successful, repeating step (c);

(e2) should said hit be unsuccessful, establishing player's score as the null value, (f) said dealer standing or hitting;

(g) if the dealer stands, establishing dealer's score based on the number of events dealt to said dealer;

(h) if the dealer hits, dealing a new random event to said dealer, said hit being deemed successful or unsuccessful based on a comparison of the associated value of said new random event to the associated value of said dealer's immediately preceding event;

(h1) should said hit be successful, repeating step (f);

(h2) should said hit be unsuccessful, establishing dealer's score as the null value, (i) resolving said player's wager.

2. The method of claim 1 wherein the random events are cards and said associated value is card rank.

3. The method of claim 2 wherein a card's value follows in sequence from a low of 2 to a high of Ace.

4. The method of claim 2 wherein one or more ordinary decks of cards are used.

5. The method of claim 1 wherein said hitting further requires a direction of higher or lower.

6. The method of claim 5 wherein said successful hit occurs if the associated value of said new random event is in the correct direction relative to the associated value of said participant's immediately preceding event.

7. The method of claim 6 wherein said successful hit additionally occurs if the associated value of said new random event is equal to the associated value of said participant's immediately preceding event.

8. The method of claim 5 wherein said direction is implied to be in a direction from the value of the immediately preceding event toward the median value of all possible random events.

9. The method of claim 1 wherein a subset of random events are automatic hand nullifiers.

10. The method of claim 1 wherein a subset of random events may be used as any value desired.

11. The method of claim 1 wherein said successful hit occurs if the associated value of said new random event is not equal to the associated value of the individual's immediately preceding event.

12. The method of claim 1 wherein the dealer banks the game.

13. The method of claim 12 wherein the standing and hitting strategy employed by said dealer in step (f) is fixed.

14. The method of claim 13 wherein said dealer must hit at least once.

15. The method of claim 13 wherein said dealer's strategy is dependent on a lower bound and higher bound value, such that the dealer will hit higher should the associated value of the dealer's immediately preceding event be less than the lower bound, the dealer will hit lower should the associated value of the dealer's immediately preceding event be greater than the higher bound, and the dealer will stand otherwise.

16. The method of claim 1 wherein the step of resolving the player's wager comprises a comparison of the player's score to the dealer's score.

17. The method of claim 1 wherein the step of resolving the player's wager comprises:

(a) if the player's score reaches a predetermined value, then the player automatically wins;

(b) if the player's score is the null value, then the player loses the wager;

(c) if the player's score is not the null value and the dealer's score is the null value, then the player wins 1 to 1 odds;

(d) if the player's score is greater than the dealer's score, then the player wins odds equal to the difference of said player's and dealer's scores;

(e) if the player's score is less than the dealer's score, then the player loses the wager;

(f) if the player's score is equal to the dealer's score, the player pushes.

18. A method of playing a game comprising the steps of:

(a) dealing a random event to a participant, said random event having an associated value;

(b) said participant standing or hitting;

(c) if the participant stands, establishing participant's score based on the number of events dealt to said participant;

(d) if the participant hits, dealing a new random event to said participant, said hit being deemed successful or unsuccessful based on a comparison of the associated value of said new random event to the associated value of said participant's immediately preceding event;

(d1) should said hit be successful, repeating step (b);

(d2) should said hit be unsuccessful, establishing participant's score as the null value;

wherein one of the participants is a dealer that represents the house in a house banked game.

19. The method of claim 18 wherein the standing and hitting strategy employed by said dealer is fixed.

20. The method of claim 18 wherein a non-dealing participant may wager on the comparison of said non-dealing participant's score to the dealer's score.

21. A method of playing a game comprising the steps of:

(a) dealing a random event to a participant, said random event having an associated value;

(b) said participant standing or hitting;

(c) if the participant stands, establishing participant's score based on the number of events dealt to said participant;

(d) if the participant hits, dealing a new random event to said participant, said hit being deemed successful or unsuccessful based on a comparison of the associated value of said new random event to the associated value of said participant's immediately preceding event;

(d1) should said hit be successful, repeating step (b);

(d2) should said hit be unsuccessful, establishing participant's score as the null value;

wherein one of the participants banks the game.

* * * * *